US005920939A

United States Patent [19]

Wörwag

[11] Patent Number: 5,920,939

[45] Date of Patent: Jul. 13, 1999

[54] FLOOR CLEANING APPARATUS HAVING A ROTATING BRUSH ROLLER

[75] Inventor: Peter Wörwag, Romanshorn, Switzerland

[73] Assignee: Firma Fedag, Romanshorn, Switzerland

[21] Appl. No.: 08/899,080

[22] Filed: Jul. 23, 1997

[51] Int. Cl.[6] ..... A46B 13/02

[52] U.S. Cl. ..... 15/41.1; 15/52.1; 15/79.2; 15/83

[58] Field of Search ..... 15/41.1, 43, 44, 15/45, 48, 48.1, 49.1, 52.1, 349, 79.1, 79.2, 83

[56] References Cited

U.S. PATENT DOCUMENTS

| | | | |
|---|---|---|---|
| 3,906,585 | 9/1975 | Mattson | 15/349 |
| 4,369,539 | 1/1983 | Nordeen | 15/52.1 |
| 4,701,969 | 10/1987 | Berfield et al. | 15/41.1 |
| 4,878,261 | 11/1989 | Rosendall | 15/41.1 |
| 5,184,367 | 2/1993 | Haaga | 15/41.1 |
| 5,617,611 | 4/1997 | Wörwag | 15/331 |

*Primary Examiner*—Mark Spisich
*Assistant Examiner*—Theresa T. Snider
*Attorney, Agent, or Firm*—Robert W. Becker & Associates

[57] ABSTRACT

A floor cleaning apparatus having a brush chamber formed in a main housing is provided. The brush chamber has a dirt inlet slot that faces the floor that is to be cleaned and extends over the width of the brush chamber transverse to the direction of work. Rotatably mounted in the brush chamber is a brush roller that is driven by a motor. The bristles of the brush roller extend outwardly through the dirt inlet slot. The brush chamber communicates via a connecting channel with a dirt collecting chamber. To ensure a reliable sweeping-up of dirt and a simple emptying of the apparatus, the dirt collecting chamber directly adjoins the main housing and is formed in an independent chamber housing that is separable from the main housing. The chamber housing has a sweeping ramp that leads to the dirt collecting chamber and a front edge that is remote from the dirt collecting chamber, extends transverse to the direction of work, and is disposed at approximately the path of the bristles of the brush roller.

16 Claims, 5 Drawing Sheets

FLOOR CLEANING APPARATUS HAVING A ROTATING BRUSH ROLLER

BACKGROUND OF THE INVENTION

The present invention relates to a floor cleaning apparatus having a brush chamber that is formed in a main housing.

A floor cleaning apparatus of this type is known from U.S. Pat. No. 4,369,539. This known apparatus comprises a main housing in which is formed a brush chamber that is provided with a dirt inlet slot. Provided in the brush chamber is a brush roller that is driven by an electric motor. The bristles of the brush roller stick out through the dirt inlet slot. Adjoining the brush chamber, via a connecting channel, is a dirt collecting chamber that is formed in a chamber housing portion. The dirt collecting chamber has a sweeping ramp that rises in a direction toward the chamber and has a front edge that is disposed approximately at the level of the path of the bristles of the brush roller.

The floor cleaning apparatus is supported on the floor by means of rollers, with the brush roller resting upon the floor. With this known floor cleaning apparatus, problems are encountered with the ability to sweep up dirt if one travels over a raised edge, such as where the type of floor covering changes, where a rug is placed on the floor, etc. Areas where the brush roller cannot reach are encountered in particular where the raised edge extends transverse to the working width of the floor cleaning apparatus.

Emptying of the known floor cleaning apparatus is also cumbersome, since the entire apparatus must be raised and appropriately tipped, in, case the guide shaft is particularly disruptive.

It is therefore an object of the present invention to provide an improved floor cleaning apparatus of the aforementioned general type that on the one hand ensures a reliable taking-up of dirt and on the other hand ensures a straightforward and complete emptying of the dirt collecting chamber.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
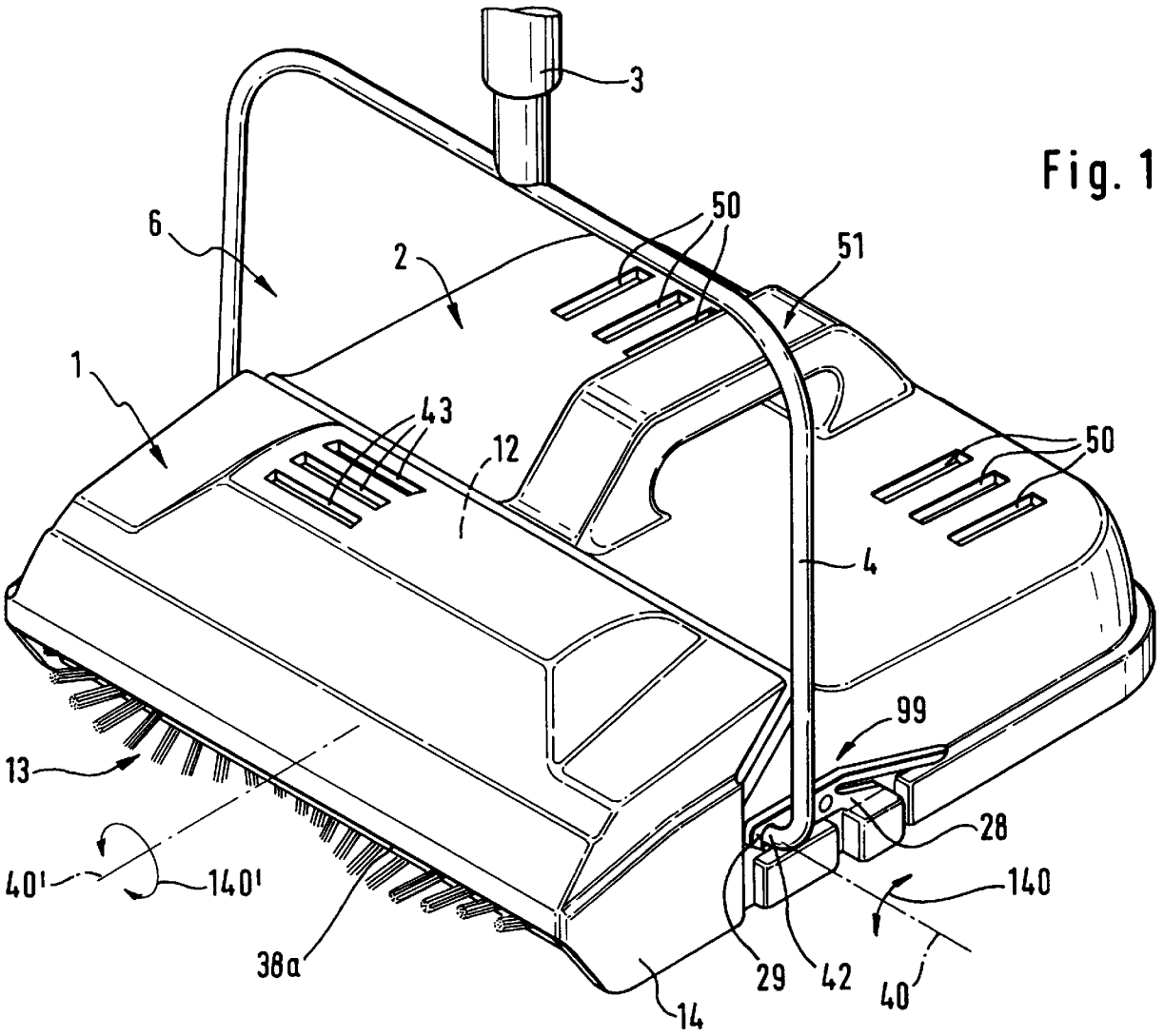
FIG. 1 is a perspective view of one exemplary embodiment of the inventive floor cleaning apparatus.

The floor cleaning apparatus of the present invention comprises: a main housing that includes a brush chamber provided with a dirt inlet slot that is adapted to face the floor that is to be cleaned, with the dirt inlet slot extending over the width of the brush chamber transverse to the direction of work; a brush roller that is rotatably mounted in the brush chamber and is driven by a motor, with the bristles of the brush roller projecting outwardly through the dirt inlet slot;

a chamber housing that is independent of and separable from the main housing, with a dirt collecting chamber of the chamber housing communicating with the brush chamber via a connecting channel, with the chamber housing further being provided with a sweeping ramp that rises in a direction toward the dirt collecting chamber and that has a front edge that is remote from such chamber, extends transverse to the direction of work, and is disposed at approximately the level of the path of the bristles of the brush roller, wherein the main housing is upwardly pivotable relative to the chamber housing over a given angle about a pivot axis that extends approximately parallel to the axis of rotation of the brush roller; and means for supporting the chamber housing on the floor, wherein the pivot axis is disposed between the brush roller and such means for supporting the chamber housing.

The main housing, with the brush roller disposed therein, is movable relative to the chamber housing with its dirt collecting chamber. This movability of the main housing ensures that the main housing can adapt to unevenness and raised edges of a floor, independent of the position of the chamber housing with its dirt collecting chamber. Independent of the overall support of the floor cleaning apparatus and the position of the chamber housing, the brush roller assumes a position that is adapted to the unevenness of the floor, thus enhancing a complete taking-up of dirt. In particular, this also makes it possible to sweep up large particles of dirt such as glass fragments, gravel, or the like; the brush roller climbs over the large dirt particle and conveys it via the sweeping ramp into the dirt collecting chamber. The pivot axis is disposed between the brush roller and a rear support of the chamber housing on the floor, as a consequence of which the front edge of the sweeping ramp, which delimits the dirt inlet slot, rests flat upon the floor that is to be cleaned in the manner of a dust pan.

The design of the floor cleaning apparatus with a main housing having a cleaning tool and a dirt collecting chamber that is easy to remove therefrom ensures easy emptying of the dirt collecting chamber. The sweeping ramp, which extends from the dirt collecting chamber to the region of the path of the bristles of the brush roller, ensures a complete, simple sweeping-up, even of difficult, large dirt particles, and the conveying thereof into the dirt collecting chamber.

To reliably prevent the escape of dirt even the floor cleaning apparatus is raised from the floor, it is proposed to provide the pivot axis of the retaining bracket on that side of the overall center of gravity of the floor cleaning apparatus that faces the main housing. If the floor cleaning apparatus is raised from the floor by the guide shaft, the overall housing in the retaining bracket will pivot about the pivot axis in such a way that the main housing faces the guide shaft, in other words, the inlet opening of the dirt collecting chamber faces away from the floor.

In order to ensure that the brush roller reliably rests upon the floor that is to be cleaned, the motor is disposed over the brush roller, preferably over the axis of rotation thereof. The weight of the motor thus effects a return force.

The sweeping ramp preferably ends at a step that delimits the dirt collecting chamber in a direction toward the rotating brush roller and brush chamber thereof. Once dirt has been swept up, it can no longer pass into the working range of the brush roller and is reliably retained, even when the floor cleaning apparatus is raised from the floor that is to be cleaned.

If the dirt inlet slot extends from the underside of the floor cleaning apparatus to the forward end wall of the main housing as viewed in the direction of work, the inventive floor cleaning apparatus ensures not only straightforward cleaning of a floor even in the corner region of a vertical wall, but it also ensures that large dirt particles are not shoved ahead of the apparatus but rather are grasped and swept in by the rotating brush roller. For this purpose, the bristles project beyond the front end wall.

To reliably grasp the dirt over the entire width of the brush roller, it is furthermore provided that the main housing be movable about a tilt axis that is disposed transverse to the pivot axis, in other words, the main housing can pivot relative to the chamber housing. When the brush roller climbs over large dirt particles, it is raised from the floor in only a partial region, whereas the rest of the brush roller continues to rest at least partially upon the floor that is to be cleaned.

Further specific features of the present invention will be described in detail subsequently.

DESCRIPTION OF PREFERRED EMBODIMENTS

Referring now to the drawings detail, the floor cleaning apparatus 6 of the illustrated embodiment comprises a main housing 1, which in the direction of work 5 is disposed toward the front, and an independent chamber housing 2 that adjoins the main housing 1 and is separable therefrom.

Figure 3:
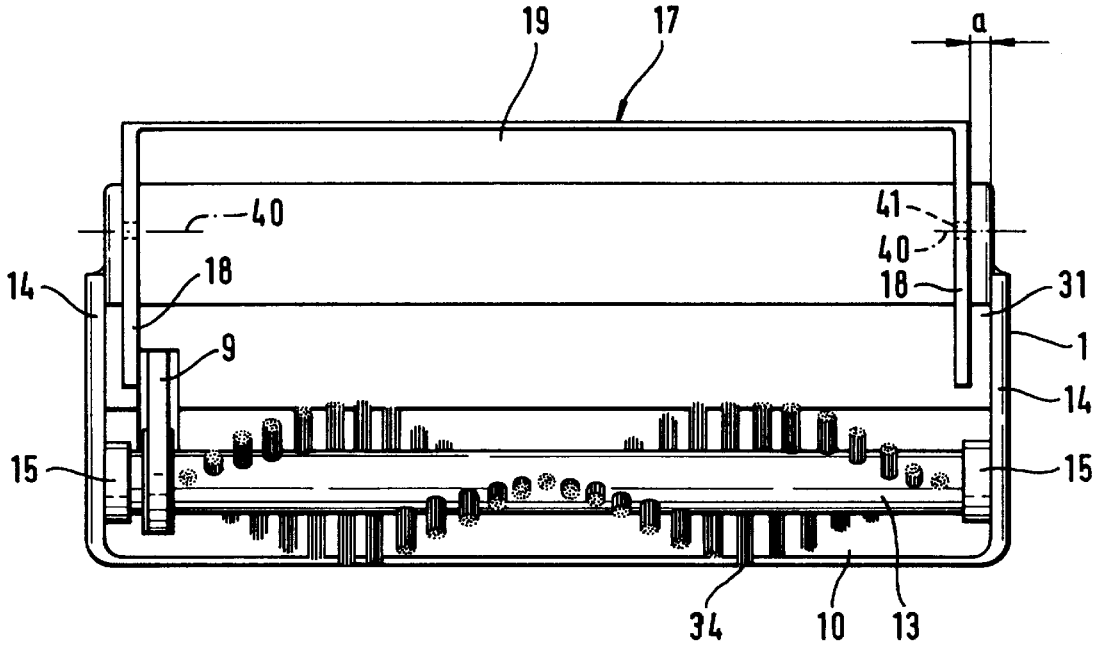
FIG. 3 is a view from below of the main housing of the floor cleaning apparatus of FIG. 1.
Figure 4:
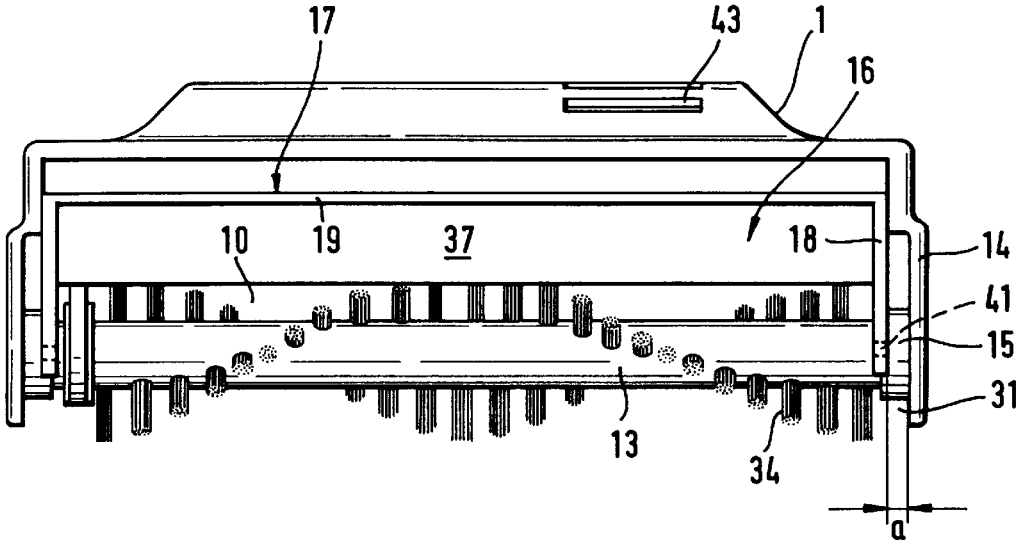
FIG. 4 is a rear view of the main housing of the floor cleaning apparatus of FIG. 1.

The main housing 1, which is illustrated separately in FIGS. 3 and 4, essentially extends transverse to the direction of work 5 over the entire width of the chamber housing 2 (see FIG. 1). Formed in the main housing 1 is a brush chamber 10 that is essentially open toward the floor 7. Formed above the brush chamber 10 is a motor chamber 12 that, as shown in FIG. 1, is narrower than the brush chamber 10. Disposed in the motor chamber 12 is an operating motor 8 that in the illustrated embodiment is an electric motor, the speed of which is preferably controlled as a function of load. The electric motor can be supplied by a power cord from a main system, or by a rechargeable battery that is preferably disposed in the motor chamber 12. Other drive motors are also in principle possible, for example air turbines or the like that are driven from the suction air stream of a vacuum cleaner. By means of a belt 9, which can be a flat belt or a toothed belt, the operating motor 8 drives a brush roller 13 that is disposed in the brush chamber 10. A gear wheel drive or friction wheel drive can also be expedient, and if necessary can be provided with one or more intermediate gears. The brush roller 13 extends transverse to the direction of work 5 over the entire width of the brush chamber 10 and is rotatably held in the side walls 14 of the brush chamber 10. Bearings or journals 15 are preferably pressed into the side walls 14; these bearings or journals can be embodied as plastic journals or friction bearings. By elastically bending the plastic side walls 14, the brushes can easily be released from their bearings and can be removed from the brush chamber 10 for cleaning.

Figure 2:
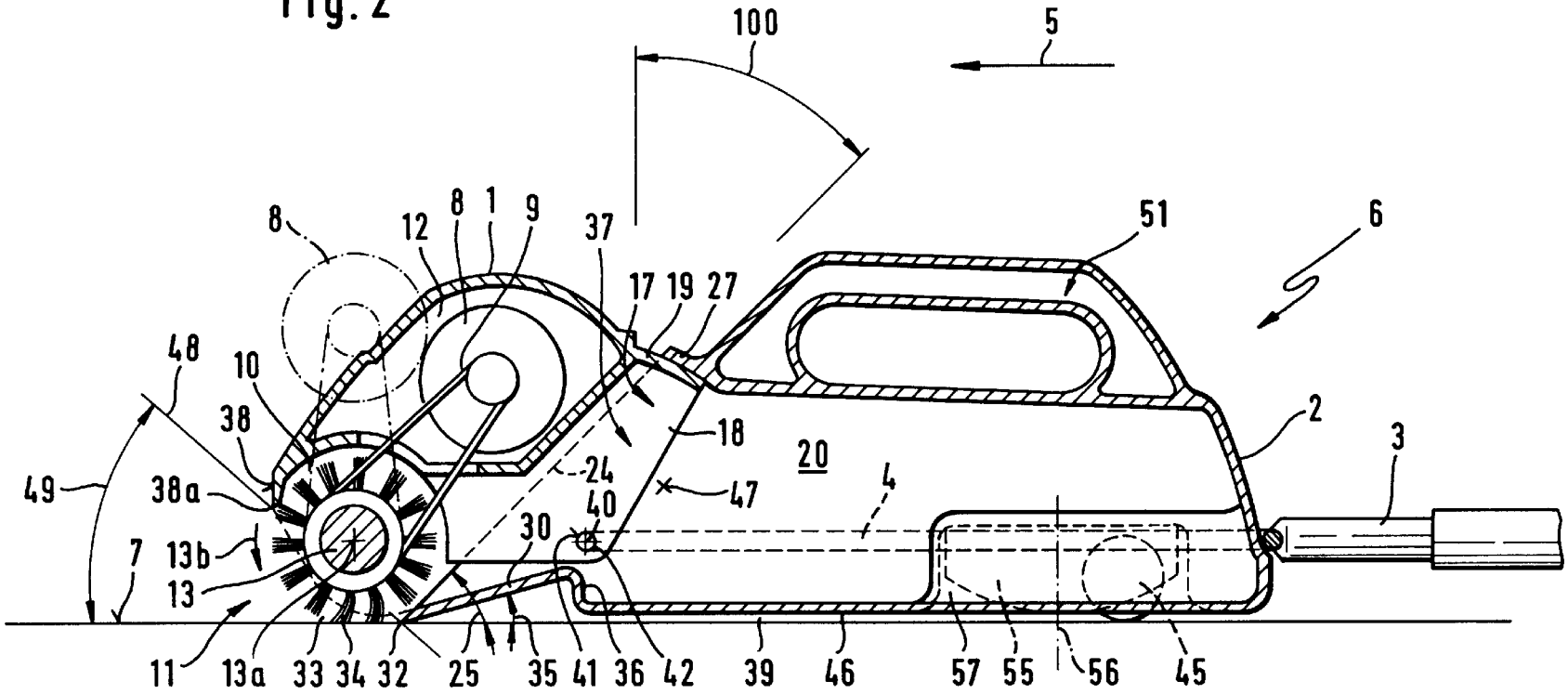
FIG. 2 is a cross-sectional view through the floor cleaning apparatus of FIG. 1.

A U-shaped wall 17 is formed on the rear side 16 (FIG. 4) of the main housing 1 that faces the chamber housing 2; the open side of the U of the wall 17 faces the floor 7 (FIG. 2). The side walls 18 of the U-shaped wall 17 extend partially parallel to and at a spacing "a" from the side walls 14 of the main housing 1, i.e. of the brush chamber 10. The crosspiece 19 of the U-shaped wall 17 spans the brush chamber 10 and is curved about an axis 40 that is defined by a respective journal opening 41 in each of the side walls 18 of the wall 17. The journal opening 41 is disposed approximately at the level of the axis of rotation 13*a* of the brush roller 13 in that region of the side walls 18 that face away from the brush chamber 10. The journal openings 41 serve for engaging the bent end portions 42 of a retaining bracket 4 that is disposed at the end of a guide shaft 3, which is advantageously embodied as a telescoping rod, for guiding the floor cleaning apparatus 6.

Figure 6:
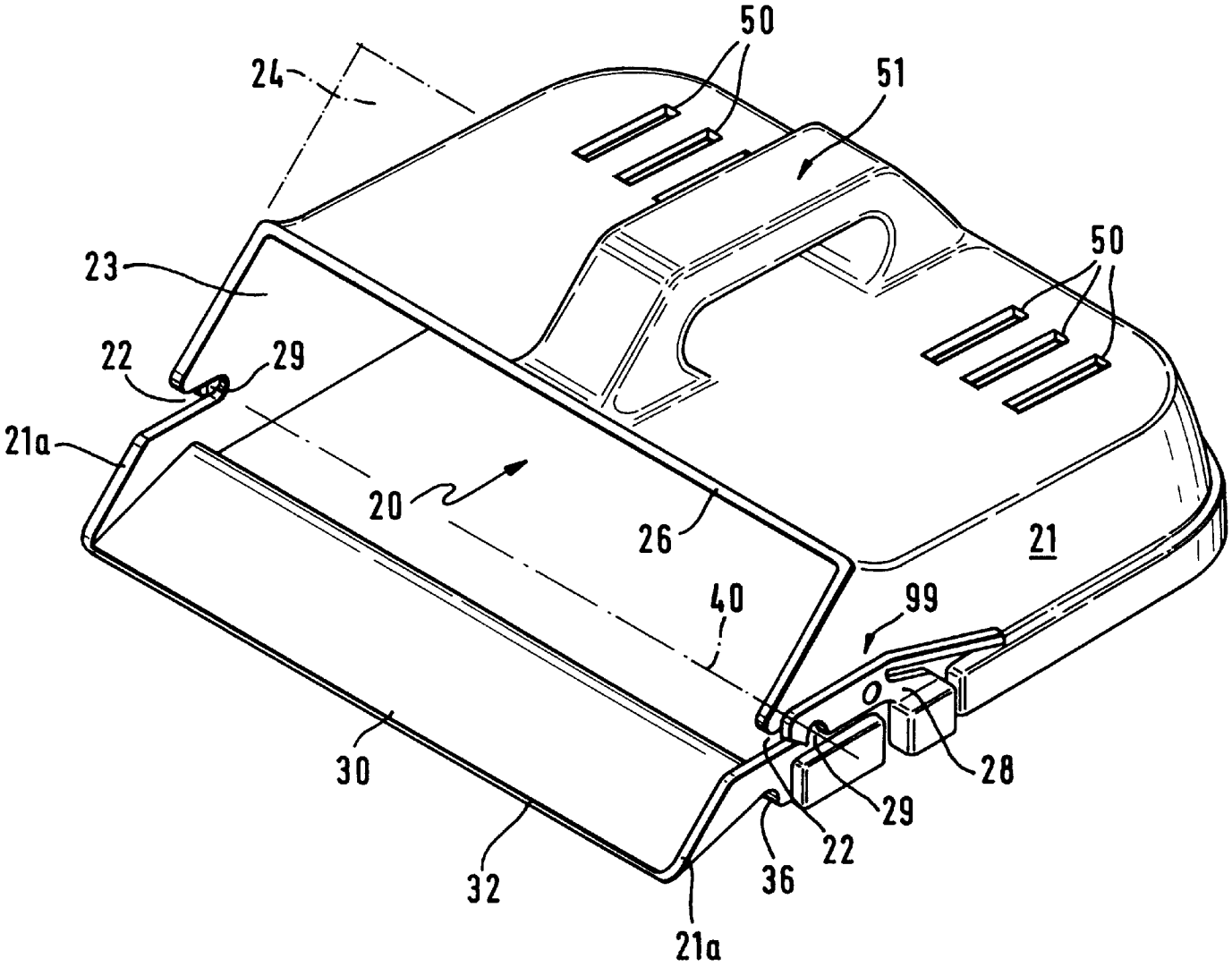
FIG. 6 is a perspective view of the chamber housing with the dirt collecting chamber formed therein.

The U-shaped or hood-shaped wall 17 extends into the chamber housing 2, which essentially forms a dirt collecting chamber 20. As can be seen in conjunction with FIG. 6, a respective elongated slot 22 is formed in each of the side walls 21 of the chamber housing 2. By means of the elongated slots 22, the chamber housing 2 can be disposed upon the end portions 42 of the retaining bracket 4 that are disposed in the journal openings 41. In so doing, the forward side wall portions 21*a* enter the free space 31 that is formed between one side wall 14 of the main housing 1 and the side wall 18 of the hood-shaped wall 17 (see FIGS. 3 and 4).

The chamber housing 2, which essentially has the shape of a dust pan that is closed on five sides, has an inlet opening 23 that is disposed in a plane 24 (FIG. 2) that extends away from the floor 7 at an angle 25 of less than 90° relative to the floor 7. With this configuration, the forward side wall portions 21*a* are disposed ahead of the upper edge 26 in the direction of work 5, as a consequence of which the wall portions 21*a* extend deeply below the main housing 1, while the upper edge 26 of the inlet opening 23 is disposed in the region of the crosspiece 19 of the wall 17. The wall portion 27 that adjoins the upper edge 26 of the inlet opening 23 of the chamber housing 2 is, in conformity with the crosspiece 19 of the wall 17, rounded or curved about the pivot axis 40. The end portions 42 of the retaining bracket 4 are disposed in the elongated slots 22, which are open toward the main housing 1, so that as a result of the configuration of the wall 17 and of the wall portion 27, the chamber housing 2 can move about the pivot axis 40 relative to the main housing 1. In order to provide a reliable yet detachable connection between the main housing 1 and the chamber housing 2, disposed on the outer sides of the side walls 21 of the chamber housing 2 are snap-type closures 99 comprised of spring-loaded latches 28. The latch opening 29 of each latch 28 extends over the end portion 42 of the retaining bracket 4 in order to safely hold the end portion 42 in the longitudinal direction of the elongated slot 22. The latches 28 can be easily opened against the spring force so that in order to empty the dirt collecting chamber 20, the chamber housing 2 can be rapidly, easily and without the use of tools withdrawn from the end portions 42 of the retaining bracket 4, i.e. from the hood-shaped walls 17.

Between the forward side wall portions 21*a* the chamber housing 2 is provided with a sweeping ramp 30 that has a front edge 32 that is disposed transverse to the direction of work 5; as can be seen in FIG. 2, the front edge 32 of the sweeping ramp 30 extends to the path 33 of the bristles 34 of the brush roller 13. The sweeping ramp 30 thus leads out of the region of the brush chamber 10 to the dirt collecting chamber 20, preferably rising at an angle 35 in the direction toward the dirt collecting chamber 20. The sweeping ramp 30 is preferably disposed approximately tangential to the path 33 of the bristles 34 of the brush roller 13.

The sweeping ramp 30 ends at a step 36 that delimits the dirt collecting chamber 20 and over which the swept-up dirt falls into the chamber 20, where it is reliably retained. Thus, the step 36 delimits the dirt collecting chamber 20 in a direction toward the main housing 1.

As a result of the selected configuration of the main housing 1 and of the chamber housing 2, the brush chamber 10 communicates with the dirt collecting chamber 20 by means of a connecting channel 37, which is delimited on the one hand by the U-shaped wall 17 and on the other hand by the sweeping ramp 30. This configuration ensures a close spatial proximity between the brush chamber 10, i.e. the brush roller 13, and the dirt collecting chamber 20.

The dirt inlet slot 11 of the brush chamber 10 faces the floor 7 and is thus delimited on the one hand by the front edge 32 of the sweeping ramp 30 and on the other hand by a housing edge 38*a* of the brush chamber 10 that extends transverse to the direction of work 5. In the illustrated embodiment, the dirt inlet slot 11 extends from the underside 39 of the floor cleaning apparatus 6 that faces the floor 7 to the end wall 38 of the main housing 1, with the end wall 38 being the forward end wall as viewed in the direction of work 5. The bristles 34 of the brush roller 13 extend out of this dirt inlet slot 11, in other words project beyond the forward end wall 38 as well as beyond the underside 39 of the floor cleaning apparatus 6. This makes possible not only a good cleaning of the floor 7 but also a front-end cleaning of the corners of rooms. In the illustrated embodiment, the dirt inlet slot 11 is disposed in a plane 48 that is defined by the front edge 32 of the sweeping ramp 30 and the housing edge 38*a*; this plane 48 forms an angle 49 with the floor 7 of preferably approximately 45° or less.

Figure 5:
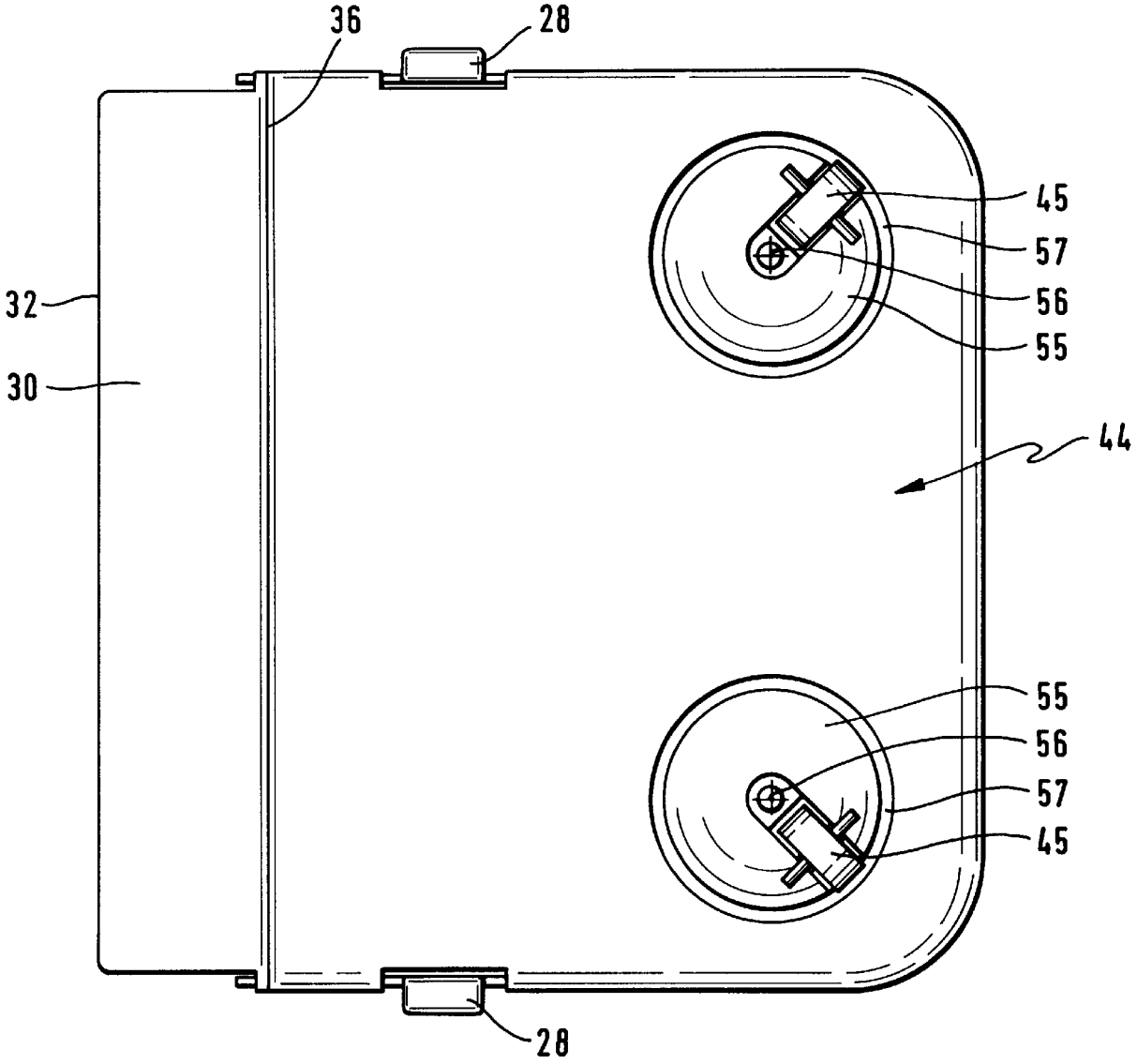
FIG. 5 is a bottom view of the chamber housing of the floor cleaning apparatus of FIG. 1.

In order to support the floor cleaning apparatus on the floor 7, rollers or casters 45 are disposed in the underside 46 of the chamber housing 2 that faces the floor 7. As shown in FIG. 5, the rollers 45 are disposed in the end portion 44 of the chamber housing 2 that is remote from the main housing 1, so that the floor cleaning apparatus 6 is supported on the one hand by the support of the bristles 34 on the floor 7 and on the other hand by the rollers 45 that are disposed at the rear end of the floor cleaning apparatus in the base of the chamber housing 2. Each roller 45 is mounted on a carrier means 55 that is rotatable about a vertical shaft 56; the carrier means 55 is disposed in a receiving cup 57. The carrier means is rotatable about 360°; a roller 45 mounted in this fashion is also designated as a pirouette wheel.

In order, when the floor cleaning apparatus is raised from the floor, to ensure that the dirt that has collected in the dirt collecting chamber 20 does not accidentally become emptied via the connecting channel 37 and the brush chamber 10, the pivot axis 40 of the retaining bracket 4 is disposed on that side of the overall center of gravity 47 of the floor cleaning apparatus 6 that faces the main housing 1.

In order to prevent air pressure or turbulence in the dirt collecting chamber 20 that would prevent the taking up of dirt, there are disposed on the upper side of the chamber housing 2 that faces the floor 7, on both sides of a handle 51, venting slots 50. In addition, for the supply or withdrawal of cooling air for the operating motor 8, similar venting slots 43 are provided in the cover of the motor chamber 12.

As a consequence of the described inventive configuration, it is possible with the floor cleaning apparatus 6 to reliably also sweep up large particles of dirt, gravel, broken glass, and the like. The floor cleaning apparatus, which is supported on the floor 7 by the brush roller 13 and the rollers 45, folds at the level of the pivot axis 40 until the front edge 32 of the sweeping ramp 30 rests upon the floor 7. If a large particle of dirt that is disposed ahead of the main housing 1 in the direction of work 5 is to be taken up, the bristles 34 of the brush roller 13 that project beyond the front end wall 38 first grasp the large particle of dirt, and then climb the large particle of dirt due to the brush roller 13 that rotates in the direction toward the sweeping ramp 30 in the direction of the arrow 13*b*. The upward movement that is necessary to effect this is possible due to the relative movement between the main housing 1, which rests upon the floor 7, and the chamber housing 2, which also rests upon the floor 7; this relative movement is permitted in a large angle 100. In this connection, the main housing 1 pivots upwardly in the direction of the arrow 140 about the axis 40. If the large particle of dirt is grasped in one end portion of the brush roller 13, the main housing 1 pivots about the axis 40 and at the same time tilts in the direction of the arrow 140' about a tilt axis 40' that is disposed transverse to the pivot axis 40. This tilting movement is possible by appropriate mounting of the end portions 42 in the journal openings 41. If the brush roller 13 has moved over the large particle of dirt this dirt particle is reliably swept up, even if the direction of work 5 is in the opposite direction. Contributing to this are also the arrangement of the motor 8 approximately over the axis of rotation 13*a* of the brush roller 13, as well as the arrangement of a possibly provided battery in the motor chamber 12. The thus provided weight loads the brush roller 13 in its starting position, in other words, makes available a return force.

The present invention is, of course, in no way restricted to the specific disclosure of the specification and drawings, but also encompasses any modifications within the scope of the appended claims.

I claim:

1. A floor cleaning apparatus comprising:

a main housing that includes a brush chamber provided with a dirt inlet slot that is constructed to face a floor that is to be cleaned, said dirt inlet slot extending over the width of said brush chamber transverse to a direction of work;

a brush roller that is rotatably mounted in said brush chamber and is driven by a motor, said brush roller being provided with bristles that project outwardly through said dirt inlet slot;

a chamber housing that is independent of and separable from said main housing, said chamber housing being provided with a dirt collecting chamber that communicates with said brush chamber via a connecting channel, said chamber housing further being provided with a sweeping ramp that rises in a direction toward said dirt collecting chamber, said sweeping ramp having a front edge that is remote from said dirt collecting chamber, extends transverse to said direction of work, and is disposed at approximately the level of a path of said bristles of said brush roller, wherein said main housing is upwardly pivotable relative to said chamber housing over a given angle about a pivot axis that extends approximately parallel to an axis of rotation of said brush roller; and means for supporting said chamber housing on said floor, wherein said pivot axis is disposed between said brush roller and said means for supporting said chamber housing.

2. A floor cleaning apparatus according to claim 1, which includes a guide shaft having a retaining bracket that extends over the main housing, wherein said pivot axis is formed by said retaining bracket.

3. A floor cleaning apparatus according to claim 2, wherein said pivot axis of said retaining bracket is disposed on that side of an overall center of gravity of said floor cleaning apparatus that faces said main housing.

4. A floor cleaning apparatus according to claim 1, wherein said motor is disposed above said brush roller in the vicinity of said axis of rotation thereof, preferably over said axis of rotation.

5. A floor cleaning apparatus according to claim 1, wherein said sweeping ramp is disposed approximately tangential to said path of said bristles of said brush roller.

6. A floor cleaning apparatus according to claim 1, wherein said sweeping ramp, remote from said front edge thereof, is provided with a step that delimits said dirt collecting chamber.

7. A floor cleaning apparatus according to claim 6, wherein said front edge of said sweeping ramp delimits said dirt inlet slot.

8. A floor cleaning apparatus according to claim 1, wherein said dirt inlet slot extends from an underside of said apparatus that faces said floor to a forward end wall of said main housing as viewed in said direction of work.

9. A floor cleaning apparatus according to claim 8, wherein said bristles of said brush roller project beyond a plane of said forward end wall.

10. A floor cleaning apparatus according to claim 8, wherein said front edge of said sweeping ramp, and an edge of said end wall of said main housing, delimit said dirt inlet slot and are disposed in a plane that forms an angle with said floor of preferably 45°.

11. A floor cleaning apparatus according to claim 1, wherein said connecting channel is delimited on the one hand by said sweeping ramp and on the other hand by said main housing.

12. A floor cleaning apparatus according to claim 1, wherein said chamber housing extends partially over said main housing.

13. A floor cleaning apparatus according to claim 1, wherein rollers are disposed on an underside of said chamber housing that faces said floor, preferably being disposed in an end portion of said chamber housing that is remote from said main housing.

14. A floor cleaning apparatus according to claim 1, wherein said main housing is movable relative to said chamber housing about a tilt axis that is disposed transverse to said pivot axis.

15. A floor cleaning apparatus according to claim 1, wherein air venting slots are disposed in said chamber housing and communicate with said dirt collecting chamber.

16. A floor cleaning apparatus according to claim 1, which includes snap-type closure means for securing said chamber housing to said main housing.

* * * * *